US009033470B2

(12) United States Patent
Bengali et al.

(10) Patent No.: US 9,033,470 B2
(45) Date of Patent: May 19, 2015

(54) FLUID EJECTION ASSEMBLY AND RELATED METHODS

(75) Inventors: Sadiq Bengali, Corvallis, OR (US); Galen P Cook, Albany, OR (US); Michael W Cumbie, Albany, OR (US); Robert K Messenger, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/978,768

(22) PCT Filed: Jan. 31, 2011

(86) PCT No.: PCT/US2011/023129

§ 371 (c)(1), (2), (4) Date: Jul. 9, 2013

(87) PCT Pub. No.: WO2012/105935

PCT Pub. Date: Aug. 9, 2012

(65) Prior Publication Data

US 2013/0286105 A1 Oct. 31, 2013

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/05* (2013.01); *B41J 2/14129* (2013.01); *B41J 2/1603* (2013.01); *B41J 2/1628* (2013.01); *B41J 2/1645* (2013.01); *B41J 2/1626* (2013.01)

(58) Field of Classification Search

None

See application file for complete search history.

(56) References Cited

U.S. PATENT DOCUMENTS

| | | | | |
|---|---|---|---|---|
| 6,365,058 | B1 * | 4/2002 | Beatty et al. | 216/27 |
| 7,004,556 | B2 | 2/2006 | Cleland et al. | |
| 7,132,132 | B2 | 11/2006 | Fartash | |
| 2005/0081585 | A1 | 4/2005 | Jones et al. | |
| 2008/0002000 | A1 | 1/2008 | Cornell et al. | |
| 2008/0088674 | A1 * | 4/2008 | Hayakawa | 347/54 |
| 2008/0106578 | A1 | 5/2008 | Shim et al. | |
| 2009/0058952 | A1 | 3/2009 | Park et al. | |
| 2010/0110144 | A1 | 5/2010 | Bibl et al. | |
| 2010/0141709 | A1 | 6/2010 | Debrabander et al. | |
| 2010/0321447 | A1 | 12/2010 | Cornell et al. | |

FOREIGN PATENT DOCUMENTS

| | | |
|---|---|---|
| JP | 2001270121 | 10/2001 |
| JP | 2003305856 | 10/2003 |

* cited by examiner

*Primary Examiner* — Erica Lin

(74) *Attorney, Agent, or Firm* — Hewlett-Packard Patent Department

(57) ABSTRACT

In one embodiment, a fluid ejection device includes a substrate with a fluid slot and a membrane adhered to the substrate that spans the fluid slot. A resistor is disposed on top of the membrane over the fluid slot, and a fluid feed hole next to the resistor extends through the membrane to the slot. A shelf extends from the edge of the resistor to the edge of the feed hole, and a passivation layer covers the resistor and part the shelf. An etch-resistant layer is formed partly on the shelf and in between the fluid feed hole and the resistor.

16 Claims, 12 Drawing Sheets

FLUID EJECTION ASSEMBLY AND RELATED METHODS

This application is a continuation of 371 National Stage PCT/US2011/023129,filed on Jan. 31, 2011.

BACKGROUND

Fluid ejection devices in inkjet printers provide drop-on-demand ejection of ink droplets. In general, inkjet printers print images by ejecting ink droplets through a plurality of nozzles onto a print medium, such as a sheet of paper. The nozzles are typically arranged in one or more arrays, such that properly sequenced ejection of ink droplets from the nozzles causes characters or other images to be printed on the print medium as the printhead and the print medium move relative to each other. In a specific example, a thermal inkjet printhead ejects droplets from a nozzle by passing electrical current through a heating element in a firing chamber. Heat from the heating element vaporizes a small portion of the fluid in the chamber, and the expanding vapor bubble forces a drop of ink from the chamber through the nozzle. When the heating element cools, the vapor bubble quickly collapses and draws more fluid through fluid feed holes into the chamber to refill the void left by the ejected fluid drop.

During printing, this ejection process can repeat thousands of times per second, and it is therefore important that the heating element be mechanically robust and energy efficient in ejecting droplets. However, there are a number of ways that the heating element can become compromised during printing. For example, the resistive heating element will corrode rapidly and be rendered ineffective if ink contacts the hot, high voltage resistor surface of the heating element. One way that ink comes in contact with the heating element is through the repeated collapsing of vapor bubbles which leads to cavitation damage to the surface material (cavitation layer) that coats the heating element. Each of the millions of collapse events ablates the material in the cavitation layer and ink eventually penetrates through and comes in direct contact with the heating element. Ink can also contact the heating element through chemical erosion or etching away of the passivation layer that underlies the cavitation layer. Wherever the passivation layer is exposed to ink, therefore, chemical etching of the passivation layer can eventually bring ink into direct contact with the heating element.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
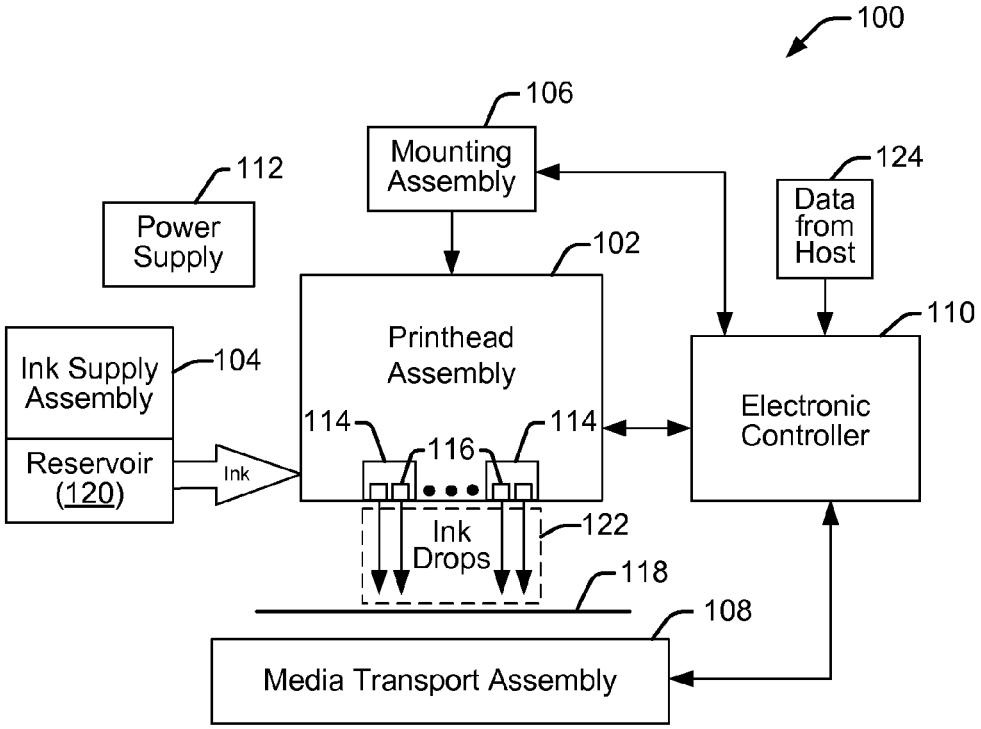
FIG. 1 shows an inkjet printing system suitable for incorporating a fluid ejection device, according to an embodiment.

As noted above, resistor heating elements in thermal inkjet printheads can be damaged and rendered ineffective when ink comes in contact with the hot, high voltage resistor material. While damage from collapsing bubbles to the thin film cavitation layer over the resistor can expose the resistor to ink from above, lateral etching of the resistor passivation layer underneath the cavitation layer can also expose the resistor to ink from the sides. In some thermal inkjet (TIJ) architectures, the passivation layer reaches laterally away from the resistor along a shelf that extends from each side of the resistor to the edges of the fluid feed holes that provide ink to the firing chamber. Therefore, chemically susceptible material in the passivation layer (e.g., SiN—silicon nitride) is exposed at the edge of the fluid feed hole (i.e., where the shelf ends) and can be etched back inward toward the resistor, both by chemical etchants used during fabrication and by ink during normal printing operation. If enough of the passivation is etched away, the resistor will be exposed to the ink and will eventually fail.

In some TIJ architectures this type of lateral etching of the thin film passivation layer self-terminates due to a starvation of the active etchant chemistry (i.e., between the ink and the chemically susceptible material in the passivation layer). Such architectures have relatively long shelf lengths (e.g., approximately 5 microns or greater) extending from the side of the resistor to the edge of the fluid feed hole, which means there is more passivation layer for the ink to etch away before it reaches the resistor. After some amount of etching into the chemically susceptible material of the passivation layer, fresh ink can no longer reach the retracting passivation interface and the etching of the passivation layer stops on its own. However, in TIJ architectures having shorter shelf lengths, as will be explained, the lesser lateral extension of the passivation layer along the shorter shelf length can allow the ink to fully etch away the chemically susceptible material in the passivation layer, exposing the resistor to ink.

One apparent solution to the problem of lateral etching of the passivation layer leading to resistor damage is to maintain longer shelf lengths in TIJ architectures. However, shorter shelf lengths provide benefits such as better fluidic performance, faster ink refills to the printhead firing chamber which improves firing performance, and reduced space needed to implement each chamber and corresponding nozzle. Another prior solution to this problem has been to simply remove the chemically susceptible thin film material from the passivation layer. The disadvantage with this approach is that it also eliminates whatever beneficial physical properties the specific thin film provided, such as thermal insulation or electrical isolation. Another possible solution would be to alter the ink chemistry to eliminate the chemical etching. However, inks are very carefully engineered to provide durability, color fastness, quick dry times, high print quality, low cost, etc., and adjusting the ink chemistry would be a significant and costly proposition.

Embodiments of the present disclosure help to prevent the lateral etching of chemically susceptible material in the thin film passivation layer of resistor heating elements in TIJ printheads, generally through providing a cap over the end of the passivation layer. During fabrication, the passivation layer is etched back away from the edge of the fluid feed hole and capped with a chemically robust thin film layer (e.g., Tantalum) that is not susceptible to being chemically etched by the ink at the edge of the fluid feed hole. Etching back the passivation layer and capping it with a chemically robust thin film material prevents ink at the edge of the fluid feed hole from contacting the chemically susceptible material in the passivation layer. This prevents the ink from etching into the passivation layer laterally and thereby protects the resistor from contact with the ink.

In one example embodiment, a fluid ejection device includes a substrate with a fluid slot and a membrane adhered to the substrate that spans the fluid slot. A resistor is disposed on top of the membrane over the fluid slot, and a fluid feed hole next to the resistor extends through the membrane to the slot. A shelf extends from the edge of the resistor to the edge of the feed hole, and a passivation layer covers the resistor and part the shelf. An etch-resistant layer is formed partly on the shelf and in between the fluid feed hole and the resistor.

In another embodiment, a method of making a fluid ejection device, includes adhering a membrane to a substrate and depositing a resistor on part of the surface of the membrane. A passivation layer is deposited over the resistor and the remaining surface of the membrane, and a portion of the passivation layer next to the resistor is etched away. A chemically resistant layer is deposited over the passivation layer and over the etched portion. A fluid feed hole is formed through the chemically resistant layer and the membrane such that the chemically resistant layer in the etched portion lies between the fluid feed hole and the resistor.

In another embodiment, an inkjet printing system has a fluid ejection device that includes a resistor on a membrane that spans a fluid slot in an underlying substrate. A fluid feed hole is formed through the membrane to the slot and creates a membrane shelf that extends between the resistor and the fluid feed hole. A passivation layer is formed over the resistor and extends partially over the shelf, and a capping layer is formed over the passivation layer and extends over a remainder of the shelf to the fluid feed hole.

Illustrative Embodiments

FIG. 1 illustrates an inkjet printing system 100 suitable for incorporating a printhead or fluid ejection device as disclosed herein, according to an embodiment. In this embodiment, the fluid ejection device/printhead is disclosed as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one fluid ejection device 114 or printhead 114 that ejects drops of ink through a plurality of orifices or nozzles 116 toward a print medium 118 so as to print onto print medium 118. Print medium 118 is any type of suitable sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed onto print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either case, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print medium 118 relative to inkjet printhead assembly 102. Thus, a print zone 122 is defined adjacent to nozzles 116 in an area between inkjet printhead assembly 102 and print medium 118. In one embodiment, inkjet printhead assembly 102 is a scanning type printhead assembly. In a scanning type printhead assembly, mounting assembly 106 includes a carriage for moving inkjet printhead assembly 102 relative to media transport assembly 108 to scan print medium 118. In another embodiment, inkjet printhead assembly 102 is a non-scanning type printhead assembly. In a non-scanning printhead assembly, mounting assembly 106 fixes inkjet printhead assembly 102 at a prescribed position relative to media transport assembly 108. Thus, media transport assembly 108 positions print medium 118 relative to inkjet printhead assembly 102.

Electronic controller or printer controller 110 typically includes a processor, firmware, and other printer electronics for communicating with and controlling inkjet printhead assembly 102, mounting assembly 106, and media transport assembly 108. Electronic controller 110 receives data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic controller 110 controls inkjet printhead assembly 102 for ejection of ink drops from nozzles 116. Thus, electronic controller 110 defines a pattern of ejected ink drops which form characters, symbols, and/or other graphics or images on print medium 118. The pattern of ejected ink drops is determined by the print job commands and/or command parameters from data 124.

In one embodiment, inkjet printhead assembly 102 includes one fluid ejection device/printhead 114. In another embodiment, inkjet printhead assembly 102 is a wide-array or multi-head printhead assembly. In one wide-array embodiment, inkjet printhead assembly 102 includes a carrier that carries multiple fluid ejection devices 114, provides electrical communication between the ejection devices 114 and electronic controller 110, and provides fluidic communication between ejection devices 114 and ink supply assembly 104.

In one embodiment, inkjet printing system 100 is a drop-on-demand thermal bubble inkjet printing system where the fluid ejection device 114 is a thermal inkjet (TIJ) fluid ejection device/printhead 114. The TIJ fluid ejection device 114 implements a thermal resistor heating element as an ejection element in an ink chamber to vaporize ink and create bubbles that force ink or other fluid drops out of a nozzle 116.

Figure 2:
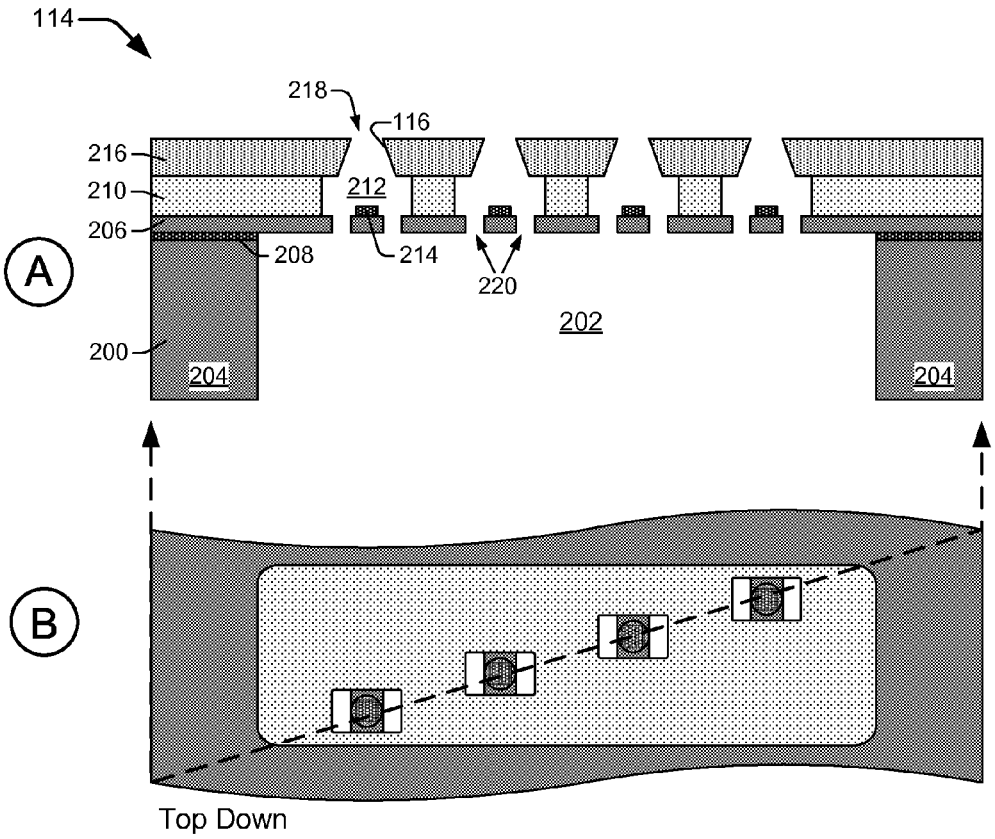
FIG. 2 shows a cross-sectional and top down view of a fluid ejection device, according to an embodiment.

FIG. 2 shows a cross-sectional view "A", and a top down view "B", of a fluid ejection device 114 (printhead 114), according to an embodiment of the disclosure. Fluid ejection device 114 includes a first substrate 200 with a fluid slot 202, or trench 202, formed therein. The elongated fluid slot 202 extends into the plane of FIG. 2A and is in fluid communication with a fluid supply, such as a fluid reservoir 120 (FIG. 1). The fluid slot 202 is a trench formed in the first substrate 200 such that sidewalls 204 of the slot 202 are formed by the substrate 200. A silicon membrane 206, or second substrate 206, is adhered to the first substrate 200 and spans the fluid slot 202. The adhesion layer 208 between the first substrate 200 and membrane 206 is a buried oxide. The first substrate 200 and membrane 206 are formed from SOI (silicon on insulator) wafers in standard micro-fabrication processes that are well-known to those skilled in the art (e.g., electroforming, laser ablation, anisotropic etching, sputtering, dry etching, photolithography, casting, molding, stamping, and machining). The oxide adhesion layer 208 between substrate 200 and membrane 206 provides a mechanism for achieving accurate etch depths during fabrication while forming features such as the fluid slot 202.

A chamber layer 210 is disposed on top of the membrane 206 and includes fluid/ink chambers 212, each having a thermal resistor heating element 214. Each resistor 214 acts as an ejection element in a chamber 212 to vaporize ink or other fluids, creating bubbles that force fluid drops out of a corresponding nozzle 116. Resistor 214 can be formed within a thin film stack applied on top of membrane 206, that generally includes a metal layer forming the resistor 214 (e.g., tantalum-aluminum (TaAl), tungsten silicon-nitride (WSiN)), a passivation layer (e.g., silicon carbide (SiC) and silicon nitride (SiN)), and a cavitation layer (e.g., tantalum (Ta)). Nozzle layer 216 is disposed on top of chamber layer 210 and has nozzles 116 formed therein that each correspond with a respective chamber 212 and resistor 214. Thus, corresponding chambers 212, resistors 214 and nozzles 116, form individual fluid drop generators 218. Fluid/ink feed holes 220 extend through membrane 206 (which forms a top for the fluid slot 202) and provide fluid communication between the fluid slot 202 and fluid chambers 212.

Figure 3A:
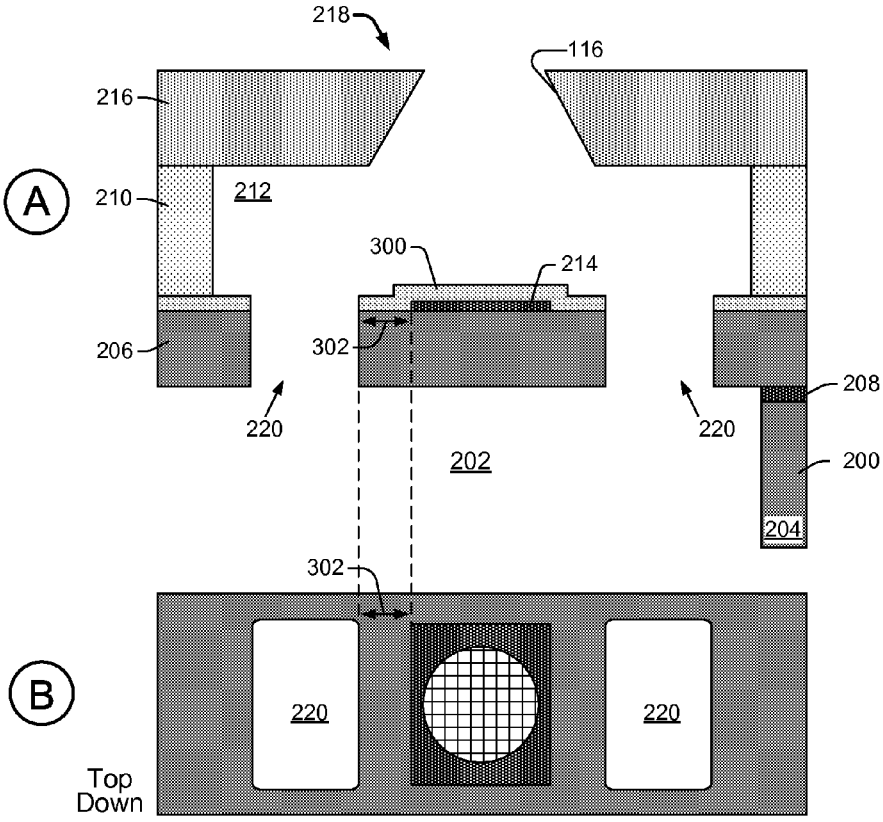
FIG. 3*a* shows a cross-sectional and top down view of an individual drop generator in a fluid ejection device, according to an embodiment.
Figure 3B:
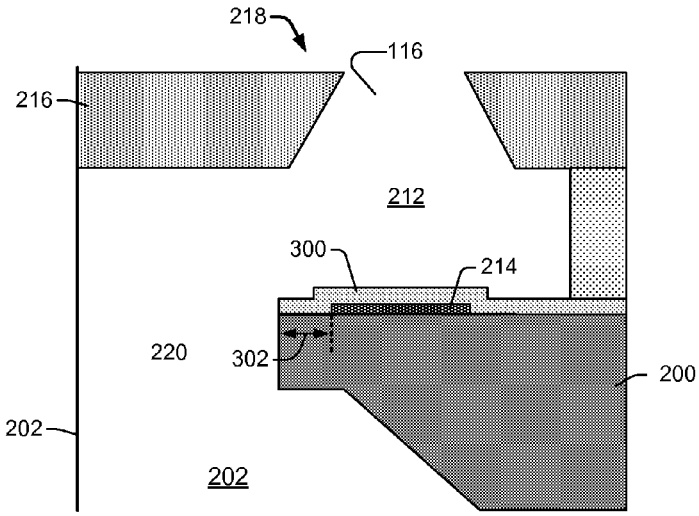
FIG. 3*b* shows a cross-sectional view of an individual drop generator in a fluid ejection device, according to an embodiment.

FIG. 3*a* shows a cross-sectional view "A", and a top down view "B", of an individual drop generator 218 in a fluid ejection device 114, according to an embodiment of the disclosure. FIG. 3*a* shows the thin film passivation layer 300 formed over the resistor 214 of a drop generator 218. The architecture of the drop generator 218 includes a short membrane shelf 302 that extends between the edges of the resistor 214 and the fluid feed holes 220. The passivation layer 300 is shown extending all the way to the edge of the shelf 302 where the shelf 302 ends at the fluid feed hole 220. Although principles disclosed herein, such as the formation of a short membrane shelf and a chemically resistance capping layer over a passivation layer, are described with respect to a particular fluid ejection device architecture (e.g., architectures shown in FIGS. 2 and 3*a*), such principles are also readily applicable to other architectures. For example, FIG. 3*b* shows a cross-sectional view of an individual drop generator 218 in a fluid ejection device 114, according to another embodiment of the disclosure. In this embodiment, drop generators 218 may be formed along both sides of the length of a fluid slot 202. Fluid feed holes 220 can be formed between the slot 202 and fluid chambers 212, resulting in a short shelf 302 in a manner similar to that discussed regarding the architecture shown in FIG. 3*a*, for example.

Figure 4:
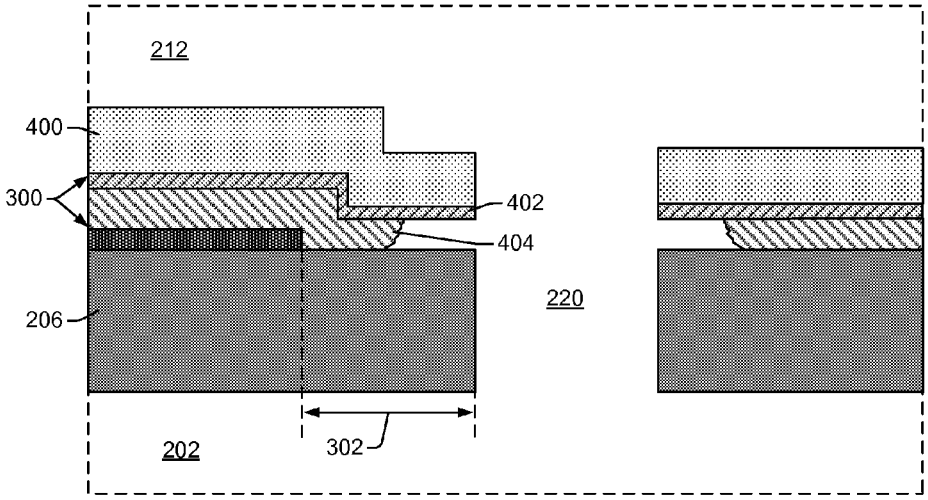
FIG. 4 shows a blown up cross-sectional view of a membrane shelf, according to an embodiment.
Figure 5:
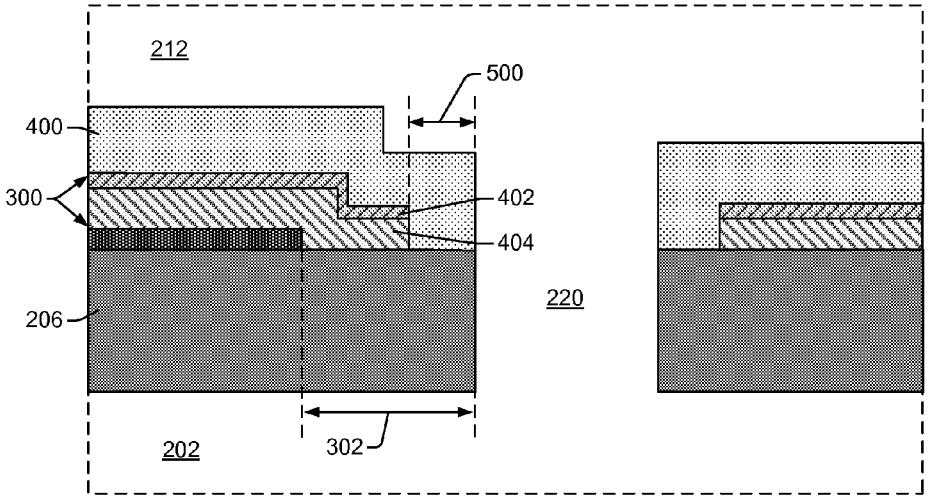
FIG. 5 shows a blown up cross-sectional view of a membrane shelf, according to an embodiment.

FIGS. 4 and 5 show blown up cross-sectional views of a membrane shelf 302, according to an embodiment of the disclosure. In FIGS. 4 and 5, the cavitation thin film layer 400 (e.g., Ta) is shown deposited over the top of the passivation layer 300. The cavitation layer 400 functions as a mechanical passivation or protective cavitation barrier structure in the fluid chamber 212 to absorb the shock of the collapsing vapor bubble and to dissipate the energy of the shock wave. The passivation layer 300 in FIGS. 4 and 5 is shown to include a thin film SiC (silicon carbide) layer 402 over a thin film SiN (silicon nitride) layer 404. The SiC thin film provides chemical isolation protection for resistor 214, while the SiN thin film serves as a dielectric layer that provides electrical isolation protection for the resistor 214. While thin film passivation and cavitation layers 300,400 are generally discussed herein as being formed of certain materials, such as SiC, SiN, and Ta, these materials are identified by way of general example only, and not by way of limitation. Therefore, a wide range of other materials are contemplated as possibly being suitable for use as a passivation layer 300 and/or cavitation layer 400. For example, materials such as gold (Au), platinum (Pt), platinum-ruthenium (PtRu) alloys, platinum-rhodium (PtRh) alloys, platinum-iridium (PrIr) alloys, iridium (Ir), tantalum (Ta), tantalum zirconium (TaZr) alloys, chromium, tantalum chromium (TaCr) alloys, nickel-chromium (NiCr) alloys, stellite 6B, cobalt-chromium (CoCr) alloys, titanium-aluminum (TiAl) alloys, titanium-nitride (TiN), tantalum-nitride (TaN), hafnium-oxide (HfO), silicon-carbide (SiC), tantalum-carbide (TaC), zirconium-oxide (ZrO), and other materials may also be suitable for use as passivation and/or cavitation layers.

As noted above, lateral etching of the passivation layer 300 underneath the cavitation layer 400 can ultimately expose the resistor 214 to ink from the sides. In TIJ architectures having longer shelf lengths (e.g., approximately 5-30 microns), lateral etching of the thin film passivation layer typically self-terminates due to a starvation of the active etchant chemistry (i.e., between the ink and SiN layer 404). That is, after a certain amount of etching into the chemically susceptible SiN material of the passivation layer 300, fresh ink can no longer reach the retracting passivation interface and the etching of the passivation layer stops on its own.

However, in TIJ architectures having short shelf lengths (e.g., as short as approximately 2-4 microns), the lesser lateral extension of the passivation layer along the short shelf length can allow the ink to fully etch away the chemically susceptible SiN material of the passivation layer 300, exposing the resistor to ink. FIG. 4 shows the exposed edge of the chemically susceptible SiN layer 400 of the passivation layer 300 being etched by ink from the fluid feed hole 220. Depending on the length of the shelf 302, the lateral etching shown may or may not terminate. Accordingly, to prevent lateral etching of the passivation layer 300, FIG. 5 shows a short shelf 302 architecture where a different fabrication technique has been applied to the thin film layers, resulting in the Ta (tantalum) cavitation layer 400 acting as a chemically protective cap 500 on the end of the etched back passivation layer 300.

As noted above, numerous materials are contemplated as being suitable for use as passivation and/or cavitation layers. However, regardless of the material used, as demonstrated in FIG. 5, at least one aspect of this disclosure includes a thin film layer (e.g., a cavitation layer 400) that is chemically robust and resistant to etching by ink and other etchants being used as a cap to cover and protect a thin film passivation layer 300 that is at least partially formed of a chemically susceptible material (e.g. SiN) that is not robust when in contact with ink and other etchants.

FIGS. 6*a*, 6*b*, 7*a*,7*b*,8*a*, 8*b*, 9*a*, 9*b* show cross-sectional and top down views of different designs of a partial fluid ejection device 114 in various phases of fabrication, according to embodiments of the disclosure. The fabrication of fluid ejection device 114 can be performed using various precision microfabrication techniques such as electroforming, laser ablation, anisotropic etching, sputtering, dry etching, photolithography, casting, molding, stamping, and machining as are well-known to those skilled in the art. The top down views in each of FIGS. 6*a*, 6*b*, 7*a*, 7*b*, 8*a*,8*b*,9*a*, 9*b* primarily illustrate how the fabrication steps impact the areas where the fluid feed holes are to be formed.

Figure 6A:
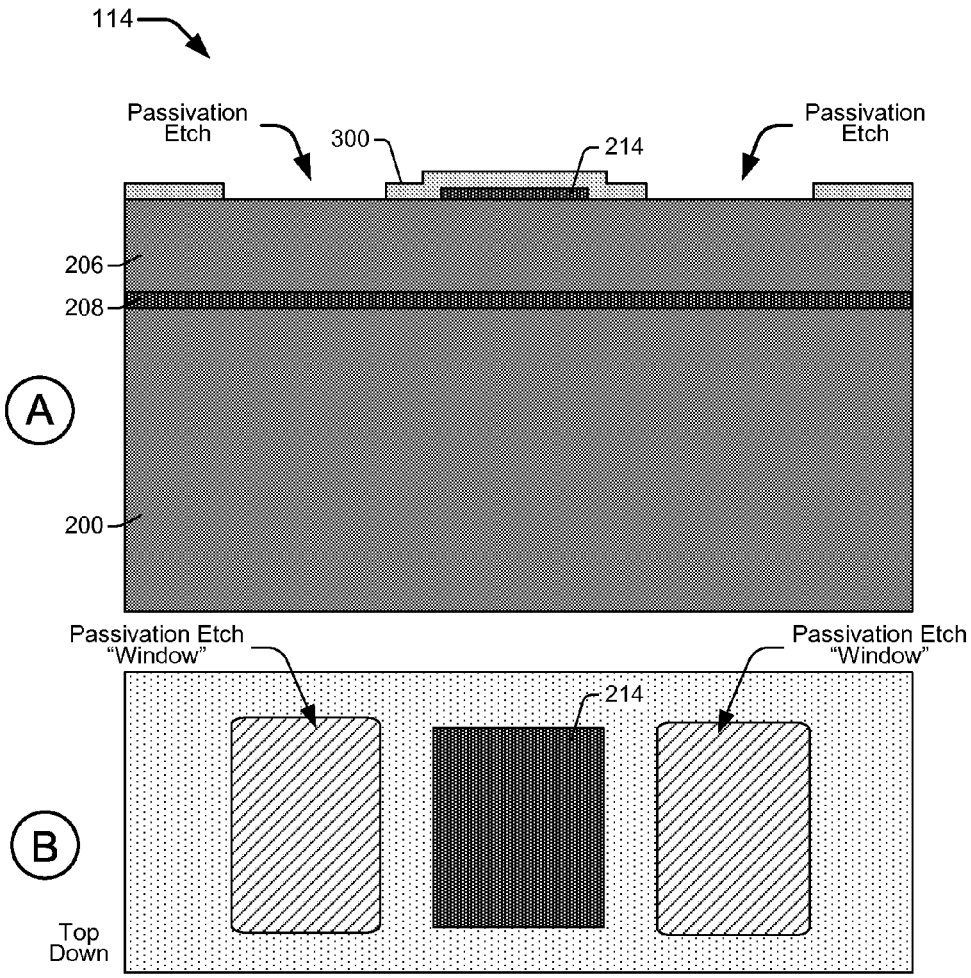
FIGS. 6*a*, 6*b*, 7*a*, 7*b*, 8*a*.8*b*, 9*a*, 9*b* show cross-sectional and top down views of different designs of a partial fluid ejection device in various phases of fabrication, according to embodiments.
Figure 6B:
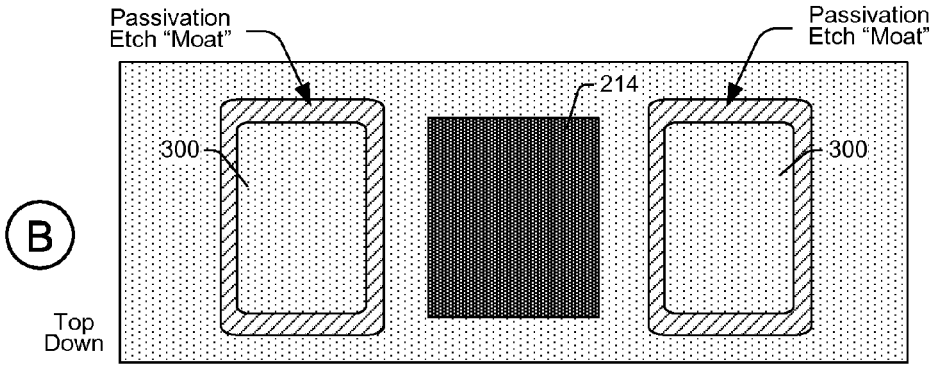

In FIGS. 6*a* and 6*b*, fabrication steps that have already been completed include the deposition of the resistor 214 onto the membrane 206. The passivation layer 300, including a thin film SiC layer over a thin film SiN layer, for example, has also been deposited over the resistor 214 and the remaining surface of membrane 206. In FIG. 6*a*, the passivation layer 300 has already been etched away in the windowed "passivation etch" areas that will be filled in by a protective film, and where the fluid feed holes will eventually be formed. The passivation etch in this fabrication step pulls the passivation layer 300 back from what will eventually be the edges of the fluid feed holes, as will become apparent below. In FIG. 6*b* (shows top down view only), a variation of the "passivation etch" is shown as a "moat" area that has been etched around the areas where the fluid feed holes will eventually be formed. In this design, a narrow ring etched around the fluid feed holes instead of a large window creates an isolation trench that will be filled in by a protective film.

Figure 7A:
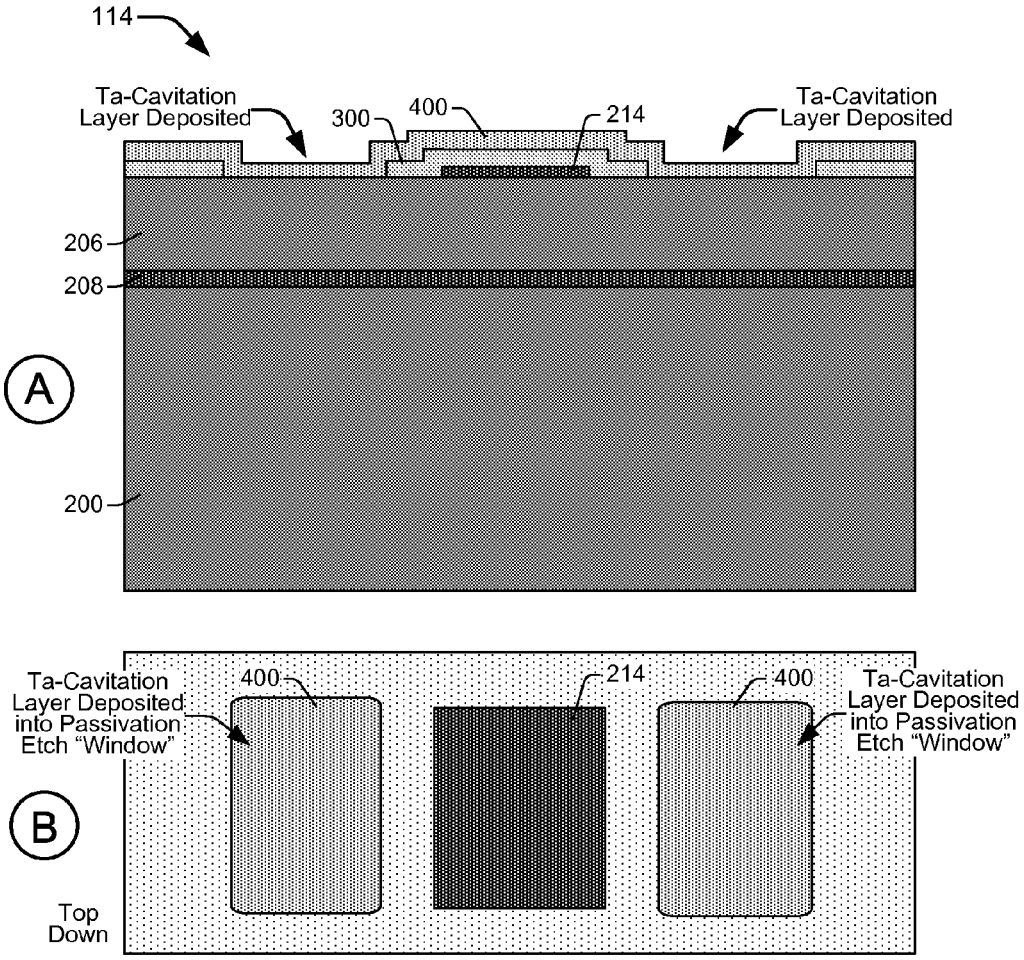
Figure 7B:
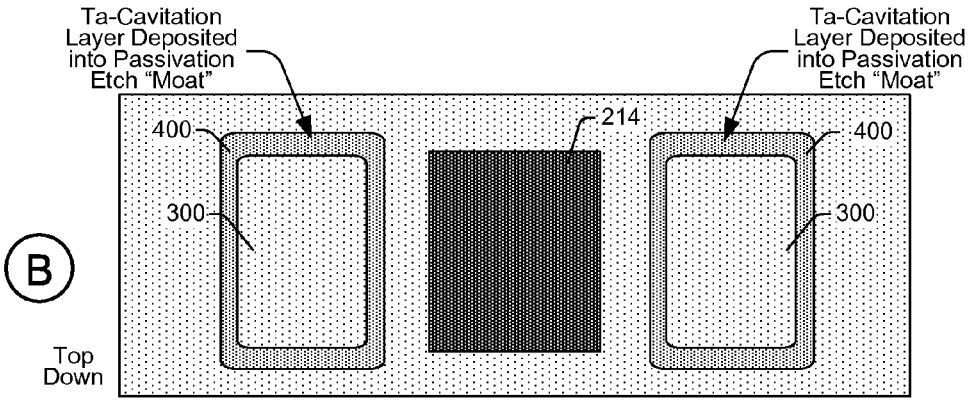

FIGS. 7*a* and 7*b* illustrate the next fabrication step of depositing the protective Ta cavitation layer 400 over the surface of the membrane 206. This Ta deposition step includes covering the passivation layer 300 and covering the "passivation etch" areas referred to in FIGS. 6*a* and 6*b*. In FIG. 7*a*, the Ta deposition into the "passivation etch" window areas provides a cap 500 over the ends of the etched back passivation layer where the passivation layer 300 has been etched, as shown in the "B" top down view. In FIG. 7*b* (shows top down view only), the Ta deposition into the "passivation etch" moat areas creates an isolation trench where the passivation layer 300 has been etched, as shown in the "B" top down view. In FIG. 7*b*, although the Ta has been deposited over the entire membrane surface area, it is shown only in the "passivation etch" moat areas for the purpose of illustration.

Figure 8A:
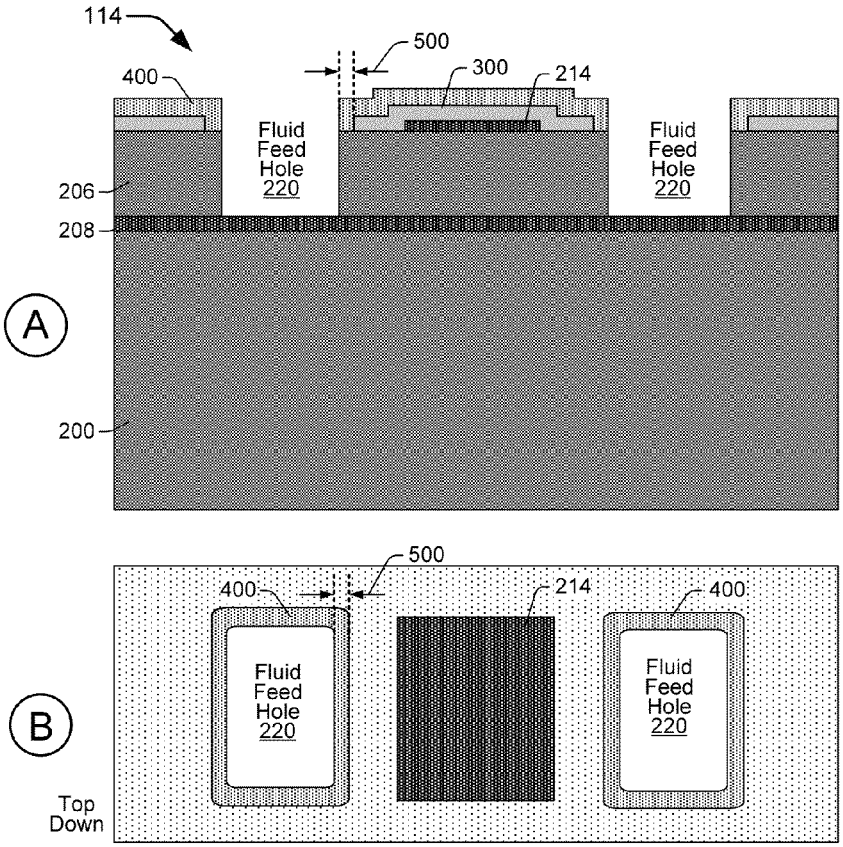
Figure 8B:
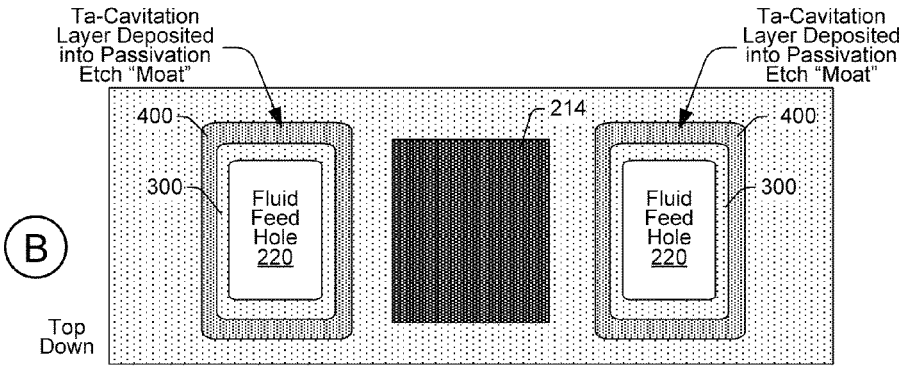

In a next fabrication step shown in FIGS. 8*a* and 8*b* , fluid feed holes are formed through both the Ta cavitation layer 400 and through the membrane 206, but not through the oxide layer 208. The oxide layer 208 acts as a natural etch stop to the fluid feed hole etch process step. It is significant to note in FIG. 8*a* that the perimeter of the fluid feed hole etch is smaller than the perimeter of the prior "passivation etch" referred to above regarding FIG. 6*a*. Thus, the fluid feed holes have a smaller perimeter and are etched within the larger windowed area of the "passivation etch". The significance of the smaller perimeter etch for the fluid feed holes is that this smaller etch maintains or retains the Ta cap 500 over the ends of the passivation layer 300, and the passivation layer 300 (including the chemically susceptible thin film SiC layer 404) is not exposed to the ink or other etchant at the edge of the fluid feed hole. In FIG. 8*b* (shows top down view only), a ring of the passivation layer 300 remains adjacent to and surrounding the fluid feed holes 220. The protective ring, or moat, of Ta material also surrounds the fluid feed holes 220 to prevent ink from the fluid feed holes 220 from etching through to the resistor 214.

Figure 9A:
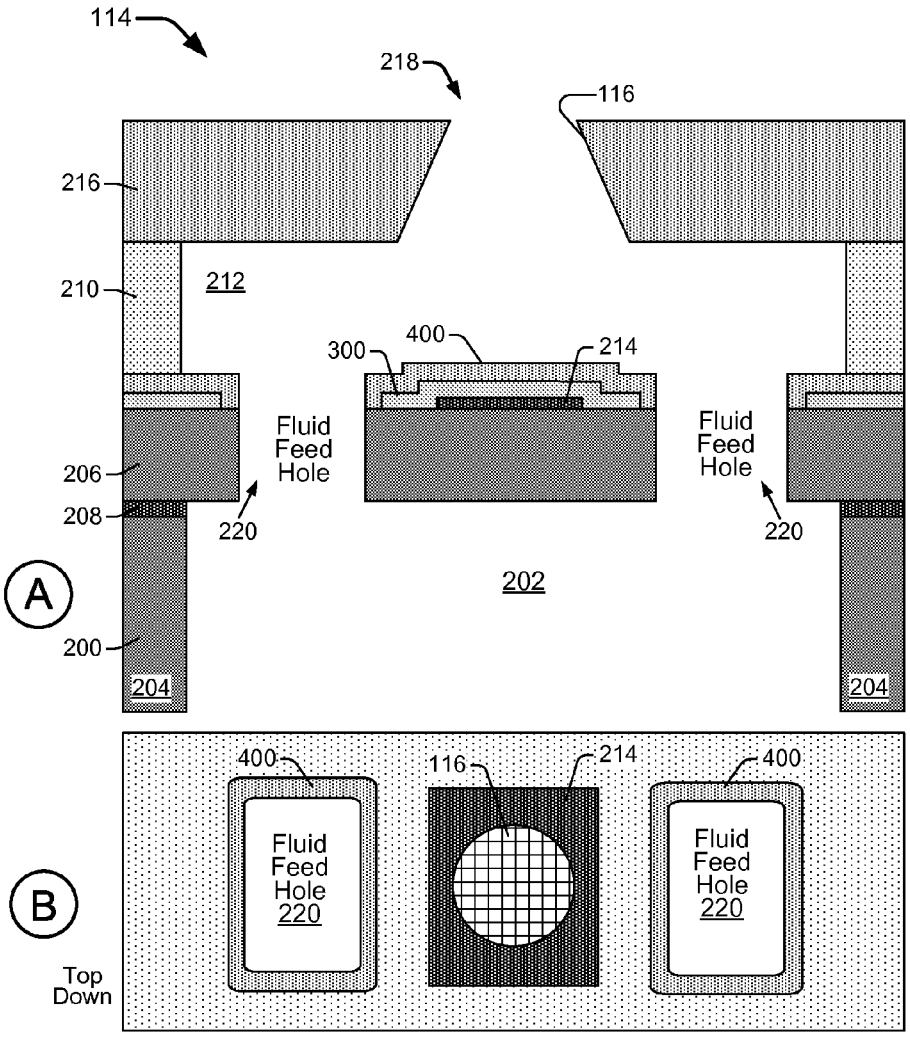
Figure 9B:
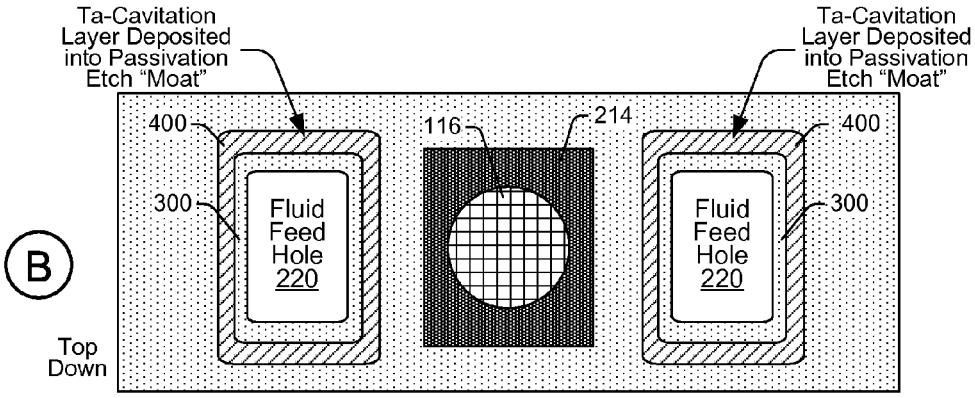

FIGS. 9*a* 9*b* illustrates the result of several additional fabrication steps to help complete the fluid ejection device fabrication. In FIG. 9*a*, the chamber layer 210 has been deposited and chambers 212 have been formed. This can be done, for example, by spin-coating an SU8 layer over the membrane 206 and using a photomask to etch the chambers 212. The nozzle layer 216 with nozzles 116 are also formed as shown in FIG. 9*a*. The fluid slot 202 is etched from the underside, and an oxide etch removes the oxide layer to join the fluid feed holes 220 with the fluid slot 202. FIG. 9*a* illustrates the windowed "passivation etch" design while FIG. 9*b* (top down view only) illustrates the moat "passivation etch" design as discussed above with reference to FIGS. 6*a* and 6*b*.

Figure 10:
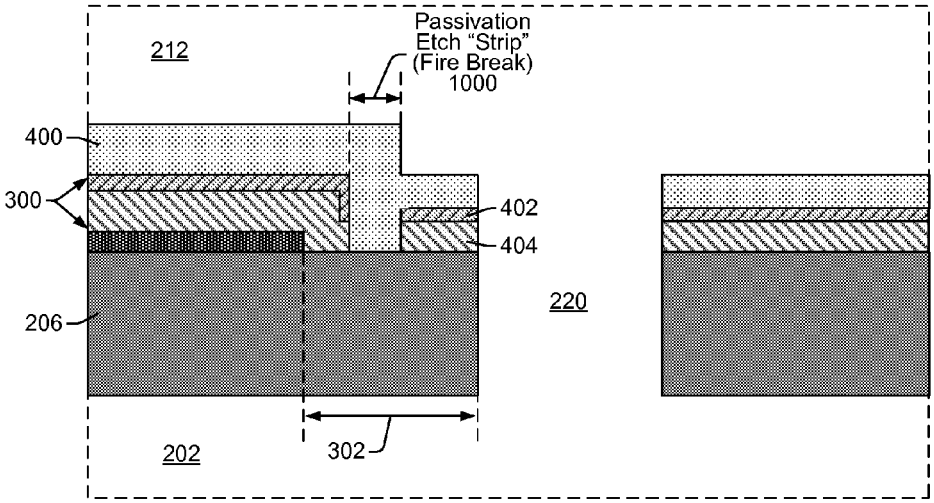
FIG. 10 shows a blown up cross-sectional view of a membrane shelf with an alternate etch design employed, according to an embodiment.

FIG. 10 shows a blown up cross-sectional view of a membrane shelf 302 where an alternate etch design is employed, according to an embodiment of the disclosure. In FIG. 10, a protective cavitation thin film layer 400 (e.g., Ta) is shown deposited over the top of the passivation layer 300 and into an etched out strip 1000 of the passivation layer 300. The etched out passivation strip 1000 is between the resistor 214 and what will eventually be the fluid feed hole 220, acting like a fire break to prevent ink from the fluid feed hole 220 from etching its way through to the resistor 214.

FIGS. 11-14 show cross-sectional "A" and top down "B" views of a partial fluid ejection device 114 in various phases of fabrication, according to embodiments of the disclosure. The fabrication steps in FIGS. 11-14 correspond in a like manner with the steps already discussed above with regard to FIGS. 6*a*, 6*b*, 7*a*, 7*b*,8*a*, 8*b*, 9*a*, 9*b*. The top down views in each of FIGS. 11-14 primarily illustrate how the fabrication steps impact the areas where the fluid feed holes are to be formed.

Figure 11:
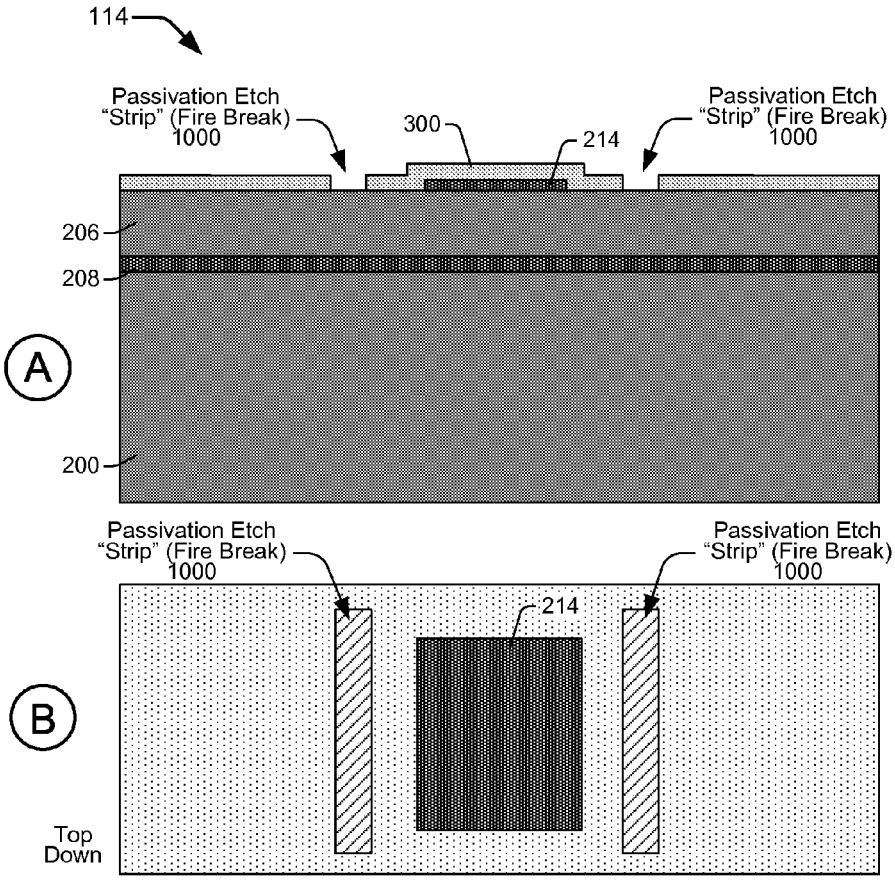
FIGS. 11-14 show cross-sectional and top down views of a partial fluid ejection device in various phases of fabrication, according to embodiments.

In FIG. 11, fabrication steps that have already been completed include the deposition of the resistor 214 onto the membrane 206. The passivation layer 300, including a thin film SiC layer over a thin film SiN layer, for example, has also been deposited over the resistor 214 and the remaining surface of membrane 206. The passivation layer 300 has already been etched away in the "passivation etch" strip areas that will be filled in by a protective film and act like a fire break to prevent ink from the fluid feed hole 220 from etching its way through to the resistor 214.

Figure 12:
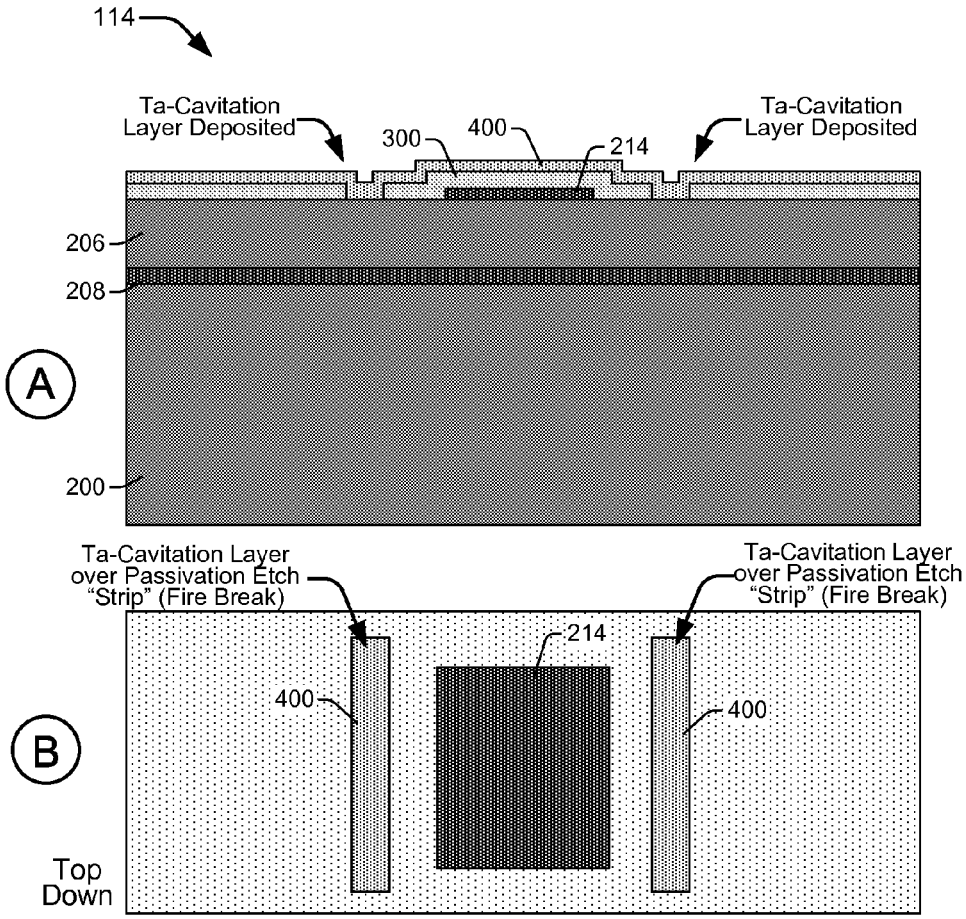

FIG. 12 illustrates the next fabrication step of depositing the protective Ta cavitation layer 400 over the surface of the membrane 206. This Ta deposition step includes covering the passivation layer 300 and covering the "passivation etch" strip areas 1000. In FIG. 12, the Ta deposition into the "passivation etch" strip provides a "fire break" that the ink could not etch beyond. Thus, the length of the "passivation etch" strip filled in with the protective Ta film determines a path length that the chemical etchant (e.g., the ink) would have to travel along in order to reach the resistor 214. That is, ink would have to etch around the ends of the strip before it could proceed toward the resistor 214.

Figure 13:
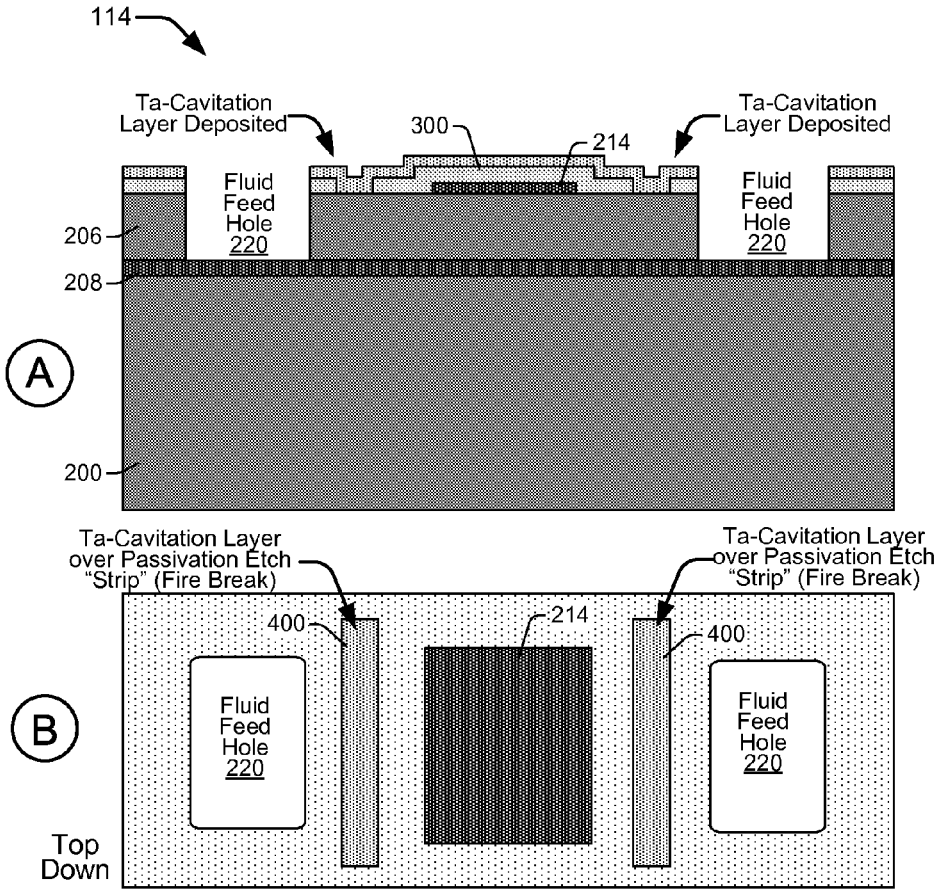
Figure 14:
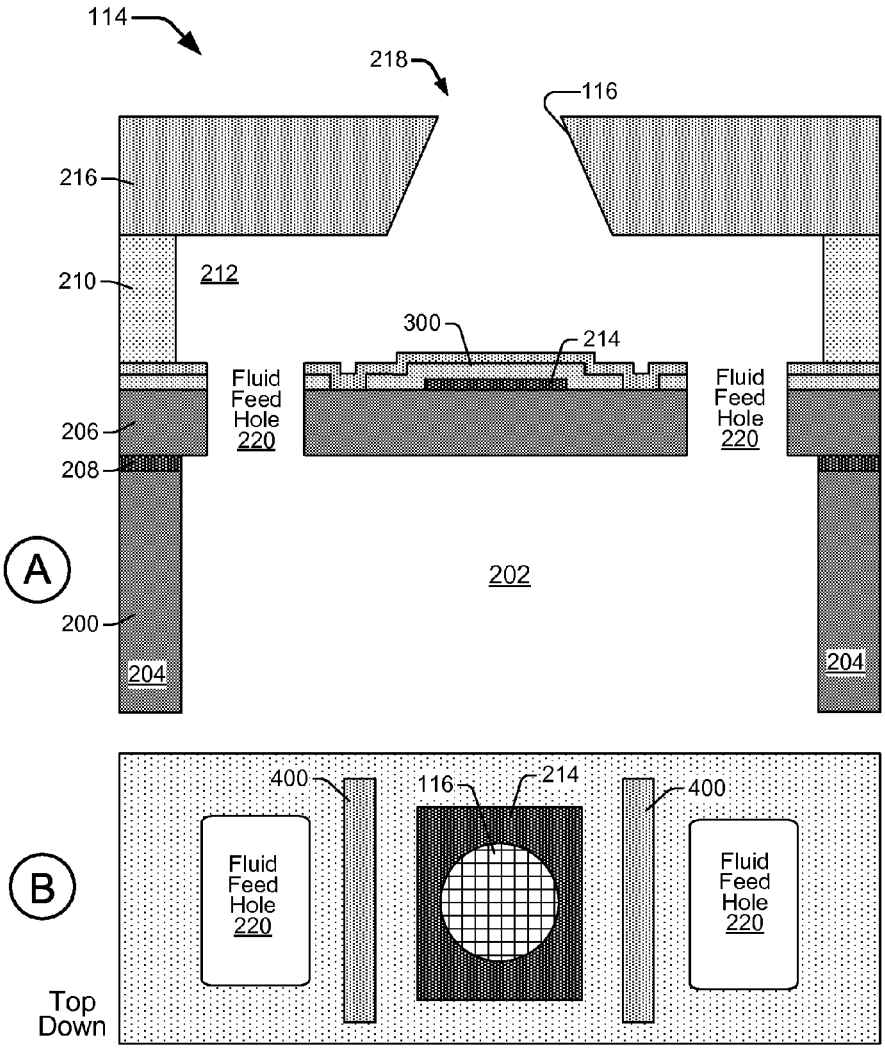

In a next fabrication step shown in FIG. 13, fluid feed holes 220 are formed through the Ta cavitation layer 400, the passivation 300, and through the membrane 206, but not through the oxide layer 208. The oxide layer 208 acts as a natural etch stop to the fluid feed hole etch process step. FIG. 14 illustrates the result of several additional fabrication steps to help complete the fluid ejection device fabrication. These steps have been discussed above with reference to FIG. 9, and they include forming chamber 212 in chamber layer 210 and forming nozzles 116 in nozzle layer 216. In addition, the fluid slot 202 is etched from the underside, and an oxide etch is used to remove the oxide layer in order to join the fluid feed holes 220 with the fluid slot 202.

What is claimed is:

1. A fluid ejection device comprising:

a substrate with a fluid slot formed therein;

a membrane adhered to the substrate and spanning the fluid slot, the substrate defining a fluid feed hole that extends through the membrane to the fluid slot;

a resistor disposed above the membrane over the fluid slot;

a shelf extending from an edge of the resistor to the fluid feed hole;

a passivation layer formed over the resistor and the shelf, the passivation layer having an end face; and an etch-resistant layer formed partly on the shelf and in between the fluid feed hole and the resistor, the etch-resistant layer to cover the end face of the passivation layer to deter lateral etching of the passivation layer.

2. A fluid ejection device as in claim 1, wherein the passivation layer covers at least part of the shelf, the passivation layer terminates prior to the fluid feed hole, and the etch-resistant layer caps the end face of the passivation layer and extends along the shelf to the fluid feed hole.

3. A fluid ejection device as in claim 1, wherein the etch-resistant layer fills in an etched-out strip of the passivation layer on the shelf.

4. A fluid ejection device as in claim 1, wherein the etch-resistant layer fills in a ring surrounding the fluid feed hole where the passivation layer has been etched out.

5. A fluid ejection device as in claim 1, further comprising:

a fluid chamber formed above the membrane and surrounding the resistor; and a nozzle layer disposed over the fluid chamber and having a nozzle associated with the resistor and the fluid chamber.

6. A fluid ejection device as in claim 1, wherein the passivation layer comprises a silicon carbide thin film over a silicon nitride thin film.

7. A method of making the fluid ejection device of claim 1, the method comprising:

adhering the membrane to the substrate;

depositing the resistor on a first portion of a surface of the membrane;

depositing the passivation layer over the resistor and a second portion of the surface of the membrane;

etching away a portion of the passivation layer adjacent the resistor;

depositing the etch-resistant layer over the passivation layer and the etched portion;

forming the fluid feed hole through the etch-resistant layer and the membrane such that the etch-resistant layer in the etched portion lies between the fluid feed hole and the resistor.

8. A method as in claim 7, wherein etching away the portion of the passivation layer comprises etching a first area, and wherein forming the fluid feed hole comprises etching through the etch-resistant layer and the membrane in a second area that falls within the first area.

9. A method as in claim 7, wherein etching away the portion of the passivation layer comprises etching a strip of the passivation layer.

10. A method as in claim 7, wherein etching away the portion of the passivation layer comprises etching a ring of the passivation layer surrounding the fluid feed hole.

11. A method as in claim 7, wherein forming the fluid feed hole comprises etching through the membrane down to a buried oxide layer disposed between the membrane and the substrate.

12. A method as in claim 7, further comprising:

forming the fluid slot in the substrate such that the fluid feed hole and the fluid slot are open to one another and the membrane spans the fluid slot.

13. A fluid ejection device as in claim 1, further comprising:

a fluid chamber formed over and surrounding the resistor, the fluid chamber in fluid communication with the fluid feed hole; and a nozzle over the fluid chamber, the nozzle being associated with the resistor and the fluid chamber.

14. A printing system comprising the fluid ejection device of claim 1.

15. A method as in claim 7, wherein the second portion surrounds the first portion.

16. A method as in claim 7, the surface comprising the first and second portions.

* * * * *